US006157318A

United States Patent [19]

Minata

[11] Patent Number: 6,157,318

[45] **Date of Patent: *Dec. 5, 2000**

[54] RADIO PAGING RECEIVER WHEREIN A POSSESSOR THEREOF CAN FREELY SET A SELECTED CALL ANNOUNCING MODE IN CORRESPONDENCE TO EVERY SENDER OF A CALL

[75] Inventor: Shigeki Minata, Shizuoka, Japan

[73] Assignee: NEC Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/998,625

[22] Filed: Dec. 29, 1997

[30] Foreign Application Priority Data

Dec. 25, 1996 [JP] Japan ..... 8-346151

[51] Int. Cl.[7] ..... G08B 5/22

[52] U.S. Cl. ..... 340/825.44; 340/825.37; 340/825.47; 340/825.22; 340/311.1; 455/38.1; 455/38.2

[58] Field of Search ..... 340/825.44, 825.37, 340/825.47, 825.22, 311.1; 455/38.1, 38.2

[56] References Cited

U.S. PATENT DOCUMENTS

| | | | |
|---|---|---|---|
| 5,394,140 | 2/1995 | Wong et al. | 340/825.44 |
| 5,495,236 | 2/1996 | Minami | 340/825.48 |
| 5,654,697 | 8/1997 | Uchida | 340/825.44 |
| 5,757,280 | 5/1998 | Motohashi | 340/825.44 |
| 5,815,081 | 9/1998 | Motohashi | 340/825.44 |

FOREIGN PATENT DOCUMENTS

| | | |
|---|---|---|
| 0 631 262 | 12/1994 | European Pat. Off. . |
| 0 684 591 | 11/1995 | European Pat. Off. . |
| 0 762 351 | 3/1997 | European Pat. Off. . |
| 4-175019 | 6/1992 | Japan . |
| 6-152499 | 5/1994 | Japan . |
| 2 071 463 | 9/1981 | United Kingdom . |
| 2 212 643 | 7/1989 | United Kingdom . |
| 2 245 091 | 12/1991 | United Kingdom . |
| 2 284 693 | 6/1995 | United Kingdom . |
| 2 303 228 | 2/1997 | United Kingdom . |
| 2 314 185 | 12/1997 | United Kingdom . |
| 2 314 440 | 12/1997 | United Kingdom . |
| WO 90/09082 | 8/1990 | WIPO . |

*Primary Examiner*—Brian Zimmerman
*Assistant Examiner*—Yves Dalencourt
*Attorney, Agent, or Firm*—Young & Thompson

[57] ABSTRACT

In a radio paging receiver for announcing, by the use of an announcing section (5) having a plurality of announcing modes, reception of a call generated by a particular sender, a memory section (8+9) memorizes, as memorized sender data, a plurality of sender data specifying a plurality of senders and memorizes, as memorized announcing mode data, a plurality of announcing mode data specifying the announcing modes of the announcing section in correspondence to the memorized sender data. Supplied with a radio signal carrying a particular sender datum specifying the particular sender, a processing section (1–4) processes the radio signal into the particular sender datum. Connected to the memory and the processing sections, a controlling section (7) controls the announcing section in response to the particular sender datum so that the announcing section announces the reception of the call in the announcing mode specified by a corresponding one of the memorized announcing mode data. The corresponding one of the memorized announcing mode data corresponds to the memorized sender datum which coincides with the particular sender datum. The controlling section controls the announcing section in response to the particular sender datum so that the announcing section does not announce the reception of the call in any of the announcing modes when none of the memorized sender data coincide with the particular sender datum.

10 Claims, 11 Drawing Sheets

RADIO PAGING RECEIVER WHEREIN A POSSESSOR THEREOF CAN FREELY SET A SELECTED CALL ANNOUNCING MODE IN CORRESPONDENCE TO EVERY SENDER OF A CALL

BACKGROUND OF THE INVENTION

This invention relates to a radio paging receiver which carries out a call announcement for announcing reception of a call by the use of an announcing section having a plurality of announcing modes.

DESCRIPTION OF THE RELATED ART

A radio paging receiver (generally called a pocket bell or a pager) includes an announcing section for announcing reception of a call which includes a call number specific to the radio paging receiver and which is sent by a sender. The announcing section generally has a plurality of announcing modes, such as sound generation due to a loudspeaker or a buzzer, vibration due to a motor, and lighting or blinking due to an LED (Light Emitting Diode).

Generally, selection of a selected announcing mode from the announcing mode is carried out by a possessor of the radio paging receiver by the use of, for example, a function switch independently of the sender of the call. Alternatively, by allotting a single radio paging receiver with a plurality of call numbers, a different announcing mode is selected for each different call number.

Recently, use is realized, in a radio paging receiver, of a password which is added to the call number with the call number succeeded by the password.

Such a radio paging receiver is, for example, disclosed in Japanese Unexamined Patent Publication (JP-A) No. 175019/1992. According to this prior art which will later be described in detail, a sender sends a call with a password representative of a higher-priority call added to a transmission message so as to make the radio paging receiver display the message prior to other messages of ordinary calls. In this event, use is made of a plurality of passwords specifying the announcing modes of the same receiver. The sender can specify a desired call announcing mode of the radio paging receiver. However, a possessor of the radio paging receiver can not select a desired call announcing mode for every sender at will.

Japanese Unexamined Patent Publication (JP-A) No. 152499/1994 discloses another radio paging receiver which will also later be described in detail. This radio paging receiver carries out a call announcement by the use of an announcing section for a call with a password added thereto. For another call with no password added thereto, the call announcement is restricted by a time zone. No disclosure is made about use of the announcing section having a plurality of announcing modes. It is therefore impossible for a possessor of the radio paging receiver to freely select a desired call announcing mode for every sender.

SUMMARY OF THE INVENTION

It is therefore an object of this invention to provide a radio paging receiver capable of improving convenience for a possessor of the radio paging receiver.

It is another object of this invention to provide a radio paging receiver of the type described, wherein the possessor of the receiver can select a selected call announcing mode for every sender at will.

It is still another object of this invention to provide a radio paging receiver of the type described, wherein the possessor of the receiver can set the selected call announcing mode in correspondence to every sender.

Other objects of this invention will become clear as the description proceeds.

A radio paging receiver to which this invention is applicable includes an announcing section having a plurality of announcing modes and carries out a call announcement for announcing, by the use of the announcing section, reception of a call generated by a particular sender.

According to this invention, the receiver comprises: a memory section for memorizing, as memorized sender data, a plurality of sender data specifying a plurality of senders and for memorizing, as memorized announcing mode data, a plurality of announcing mode data specifying the announcing modes of the announcing section in correspondence to the memorized sender data; a processing section supplied with a radio signal carrying a particular sender datum specifying the particular sender for processing the radio signal into the particular sender datum; and a controlling section connected to the memory section and the processing section for controlling the announcing section in response to the particular sender datum so that the announcing section announces the reception of the call in the announcing mode specified by a corresponding one of the memorized announcing mode data, the corresponding one of the memorized announcing mode data corresponding to the memorized sender datum which coincides with the particular sender datum.

DESCRIPTION OF THE PREFERRED EMBODIMENTS

Description will be made at first as regards conventional radio paging receivers for a better understanding of this invention.

Figure 1:
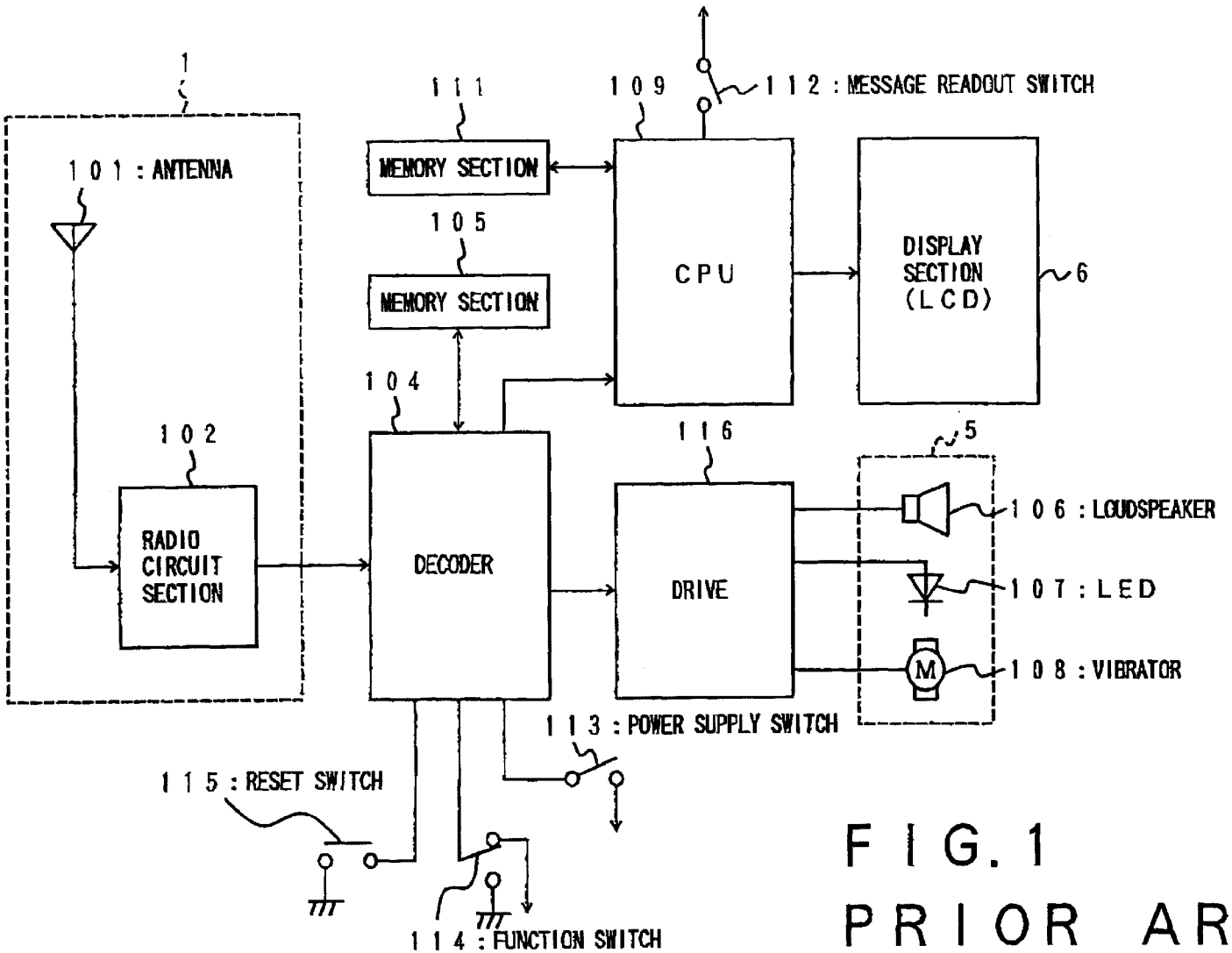
FIG. 1 PRIOR ART
FIG. 1 is a block diagram of a conventional radio paging receiver.

Referring to FIG. 1, a first conventional radio paging receiver is described which is disclosed in the above-referred Japanese Unexamined Patent Publication (JP-A) No. 175019/1992. As mentioned above, a sender sends a call with a password representative of a higher-priority call added to a transmission message so as to make the radio paging receiver display the message prior to other messages of ordinary calls.

In FIG. 1, the radio section 1 has an antenna 101 and a radio circuit section 102. The radio section 1 produces an output signal to be supplied to a decoder 104.

The decoder 104 is also connected to a memory section 105 memorizing a signal decoding procedure, a CPU (Central Processing Unit) 109, a drive 116, a power supply switch 113, a function switch for selection of announcing modes or functions, and a reset switch 115 for stopping an announcement.

The CPU 109 is connected to a memory section 111 memorizing a program for display of information (message) supplied from the decoder 104, an LCD (Liquid Crystal Display) 6 for display of the message, and a message readout switch 112 for display and readout of the message.

The drive 116 is connected to an announcing section 5 having a plurality of announcing modes of, for example, sound generation due to a loudspeaker 106, lighting or blinking due to an LED 107, and vibration due to a vibrator 108.

When the power supply switch 113 is turned on in the structure illustrated in FIG. 1, the decoder 104 is put into a standby state to become ready for reception of a preamble signal from the radio section 1.

When the radio section 1 receives the preamble signal, examination is made about whether or not a corresponding call number identical with a specific call number assigned to the receiver and memorized in the memory section 105 is present in an ID part succeeding the preamble signal. If the corresponding call number is present, a message part succeeding the ID part is supplied to the decoder 104.

Furthermore, examination is made about whether or not a corresponding password identical with a password memorized in the memory section 105 is present at the head of the message part. If the corresponding password is present, announcement control information corresponding to the password is read from the memory section 105 to make the drive circuit 116 drive a corresponding one of the loudspeaker 106, the LED 107, and the vibrator 108.

By using a plurality of passwords specifying the announcing modes of the same receiver, the sender can specify a desired call announcing mode of the radio paging receiver. However, a possessor of the radio paging receiver can not select a desired call announcing mode for every sender at will as mentioned above.

Figure 2:
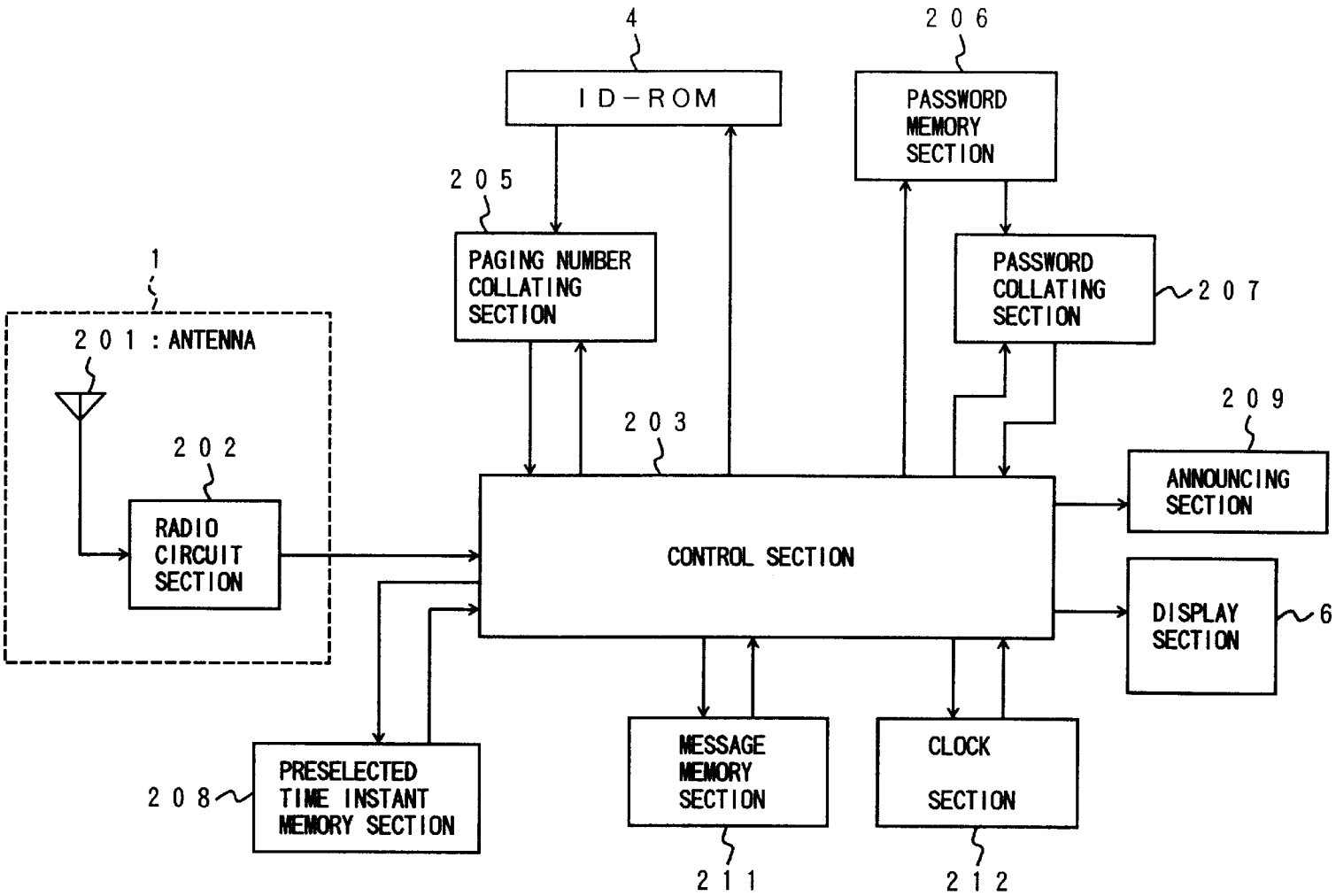
FIG. 2 PRIOR ART
FIG. 2 is a block diagram of another conventional radio paging receiver.

Referring to FIG. 2, a second conventional radio paging receiver is described which is disclosed in the above-referred Japanese Unexamined Patent Publication (JP-A) No. 152499/1994. With the structure illustrated in FIG. 2, a signal is received by an antenna 201 and demodulated by a radio circuit section 202. The antenna 201 and the radio circuit section 202 constitutes the radio section 1. A control section 203 makes a paging number collating section 205 collate a call number contained in the received signal and a specific call number assigned to the receiver and memorized in an ID-ROM (Identification code Read Only Memory) 4.

When the above-mentioned collation results in coincidence, a password collating section 207 collates a character string contained in a received message and a password memorized in a password memory section 206.

If the collation of the password results in coincidence therebetween, announcement is carried out by an announcing section 209 or a display section 6. On the other hand, in case of incoincidence therebetween, the control section 203 reads a current time instant from a clock section 212 for comparison with an announcement limitation starting time instant or a limitation cancelling time instant preliminarily set in a preselected time instant memory section 208. Announcement is executed only when no limitation is imposed.

In case where no announcement is executed because of an announcement limitation period, the control section 203 makes a message memory section 211 memorize the received message. At a time instant when the announcement limitation is cancelled, the message is announced.

In the described manner, this radio paging receiver carries out a call announcement by the use of the announcing section 209 for a call with the password added thereto. For another call with no password added thereto, the call announcement is restricted by a time zone. No disclosure is made about use of the announcing section having a plurality of announcing modes. It is therefore impossible for a possessor of the radio paging receiver to freely select a desired call announcing mode for every sender.

Figure 3:
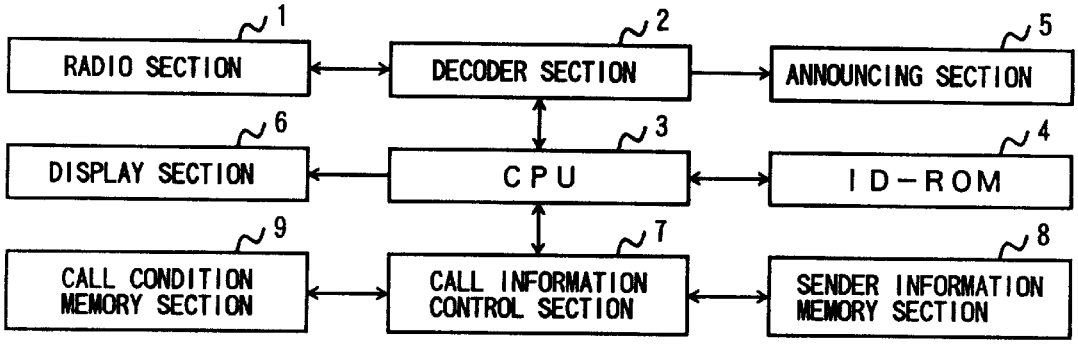
FIG. 3 is a block diagram of a radio paging receiver according to a first embodiment of this invention.

Turning to FIG. 3, description will proceed to a radio paging receiver according to a first embodiment of this invention. The radio paging receiver comprises similar parts designated by like reference numerals.

The radio paging receiver includes the announcing section 5 having a plurality of announcing modes like the radio paging receiver illustrated in FIG. 1. The radio paging receiver carries out a call announcement for announcing, by the use of the announcing section 5, reception of a call generated by a particular sender.

The radio paging receiver further includes a memory section (8, 9). As will later be described in detail, the memory section (8, 9) memorizes, as memorized sender data (or information), a plurality of sender data (or information) specifying a plurality of senders and memorizes, as memorized announcing mode data (or information), a plurality of announcing mode data (or information) specifying the announcing modes of the announcing section 5 in correspondence to the memorized sender data (or information). A possessor of the radio paging receiver can freely input or store a plurality of the sender data (or information) and a plurality of the announcing mode data (or information) in the memory section.

Supplied with a radio signal which carries a specific call number specific to the radio paging receiver and a particular sender datum (or information) which specifies the particular sender and which succeeds the specific call number, a processing section (1–4) processes the radio signal into the particular sender datum (or information) when the processing section (1–4) detects the specific call number. The processing section (1–4) will also later be described in detail.

Connected to the memory section (8, 9) and the processing section (1–4), a control section 7 controls the announcing section 5 in response to the particular sender datum (or information) so that the announcing section 5 announces the reception of the call in the announcing mode specified by a corresponding one of the memorized announcing mode data (or information). The corresponding one of the memorized announcing mode data (or information) corresponds to the memorized sender datum (or information) which coincides with the particular sender datum (or information). Such operation of the control section 7 is carried out either at steps Sa4–Sa8 of FIG. 4 or at other steps Sb4–Sb8 of FIG. 5 as will also later be described.

When none of the memorized sender data (or information) coincide with the particular sender datum (or information), the control section 7 controls the announcing section 5 in response to the particular sender datum (or information) so that the announcing section 5 does not announce the reception of the call in any of the announcing modes either at steps Sa4 and Sa9 of FIG. 4 or at other steps Sb4 and Sb11 of FIG. 5 as will later be described.

Figure 4:
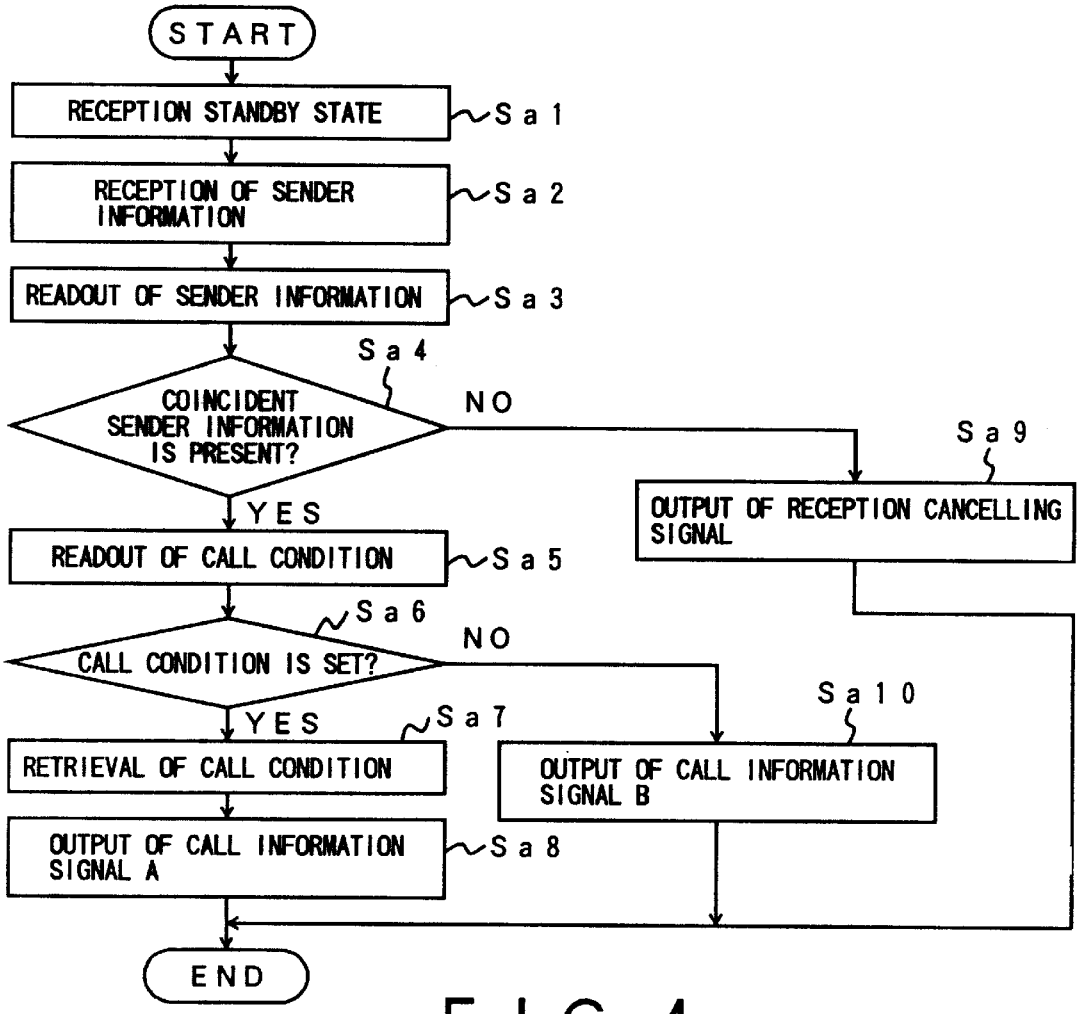
FIG. 4 is a flow chart for describing an operation of a call information control section in FIG. 3.
Figure 5:
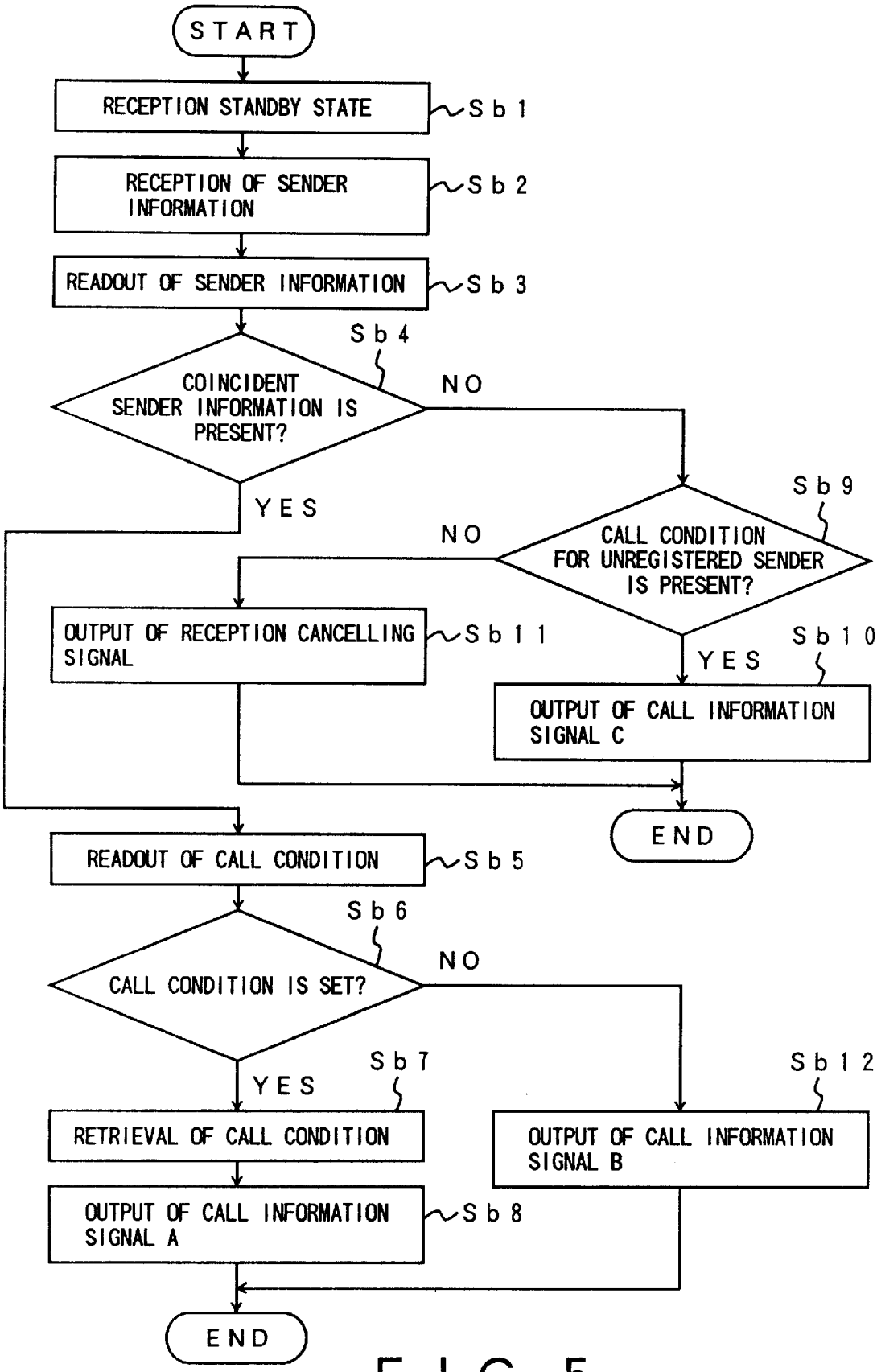
FIG. 5 is a flow chart for describing another operation of a call information control section in FIG. 3.

When no announcing mode datum (or information) is memorized in the memory (8, 9) in correspondence to the memorized sender datum (or information) which coincides with the particular sender datum (or information), the control section 7 controls the announcing section 5 in response to the particular sender datum (or information) so that the announcing section 5 announces the reception of the call in a predetermined mode of the announcing modes either at steps Sa6 and Sa10 of FIG. 4 or at other steps Sb6 and Sb12 of FIG. 5 as will also later be described.

Figure 6:
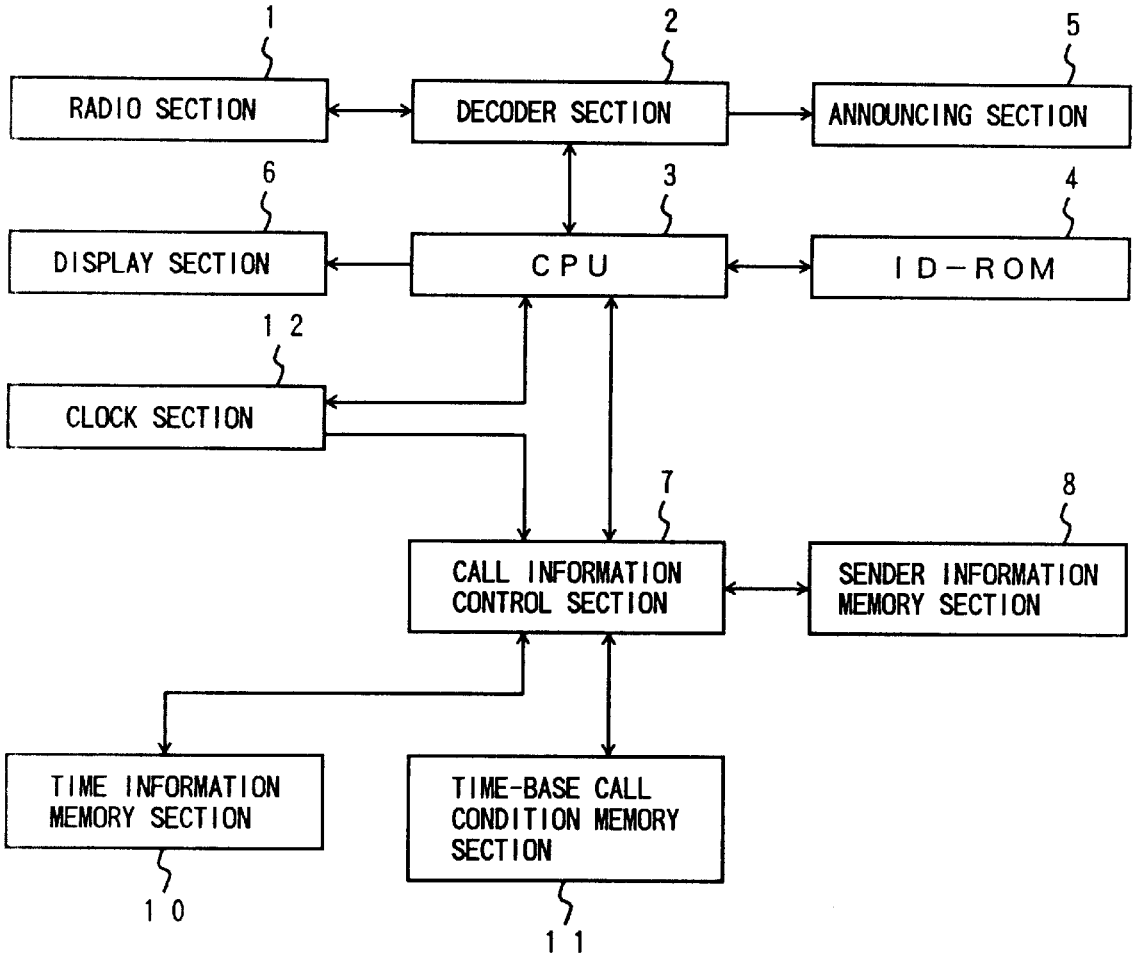
FIG. 6 is a block diagram of a radio paging receiver according to a second embodiment of this invention.

Turning to FIG. 6, description will proceed to a radio paging receiver according to a second embodiment of this invention. The radio paging receiver comprises similar parts designated by like reference numerals.

The memory section (8, 11) further includes another section (10) which memorizes, as memorized time zone data (or information), a plurality of time zone data (or information) specifying time zones in correspondence to the memorized sender data (or information) as will also later be described. A possessor of the radio paging receiver can input or store a plurality of the time zone data (or information) in the section (10) at will.

In cooperation with a clock section 12 (later described), the control section 7 controls the announcing section 5 in response to the particular sender datum (or information) so that the announcing section 5 announces the reception of the call in the above-mentioned corresponding one of the memorized announcing mode data (or information) when a reception time of the particular sender datum (or information) is within the time zone specified by a corresponding one of the memorized time zone data (or information). The corresponding one of the memorized time zone data corresponds to the memorized sender datum (or information) which coincides with the particular sender datum (or information). Such operation of the control section 7 is carried out at steps Sc7–Sc11 of FIG. 7 as will later be described.

When the reception time of the particular sender datum (or information) is out of the time zone specified by the corresponding one of the memorized time zone data (or information), the control section 7 controls the announcing section 5 in response to the particular sender datum (or information) so that the announcing section 5 does not announce the reception of the call in any of the announcing modes at steps Sc7 and Sc14 of FIG. 7 as will later be described.

Figure 8:
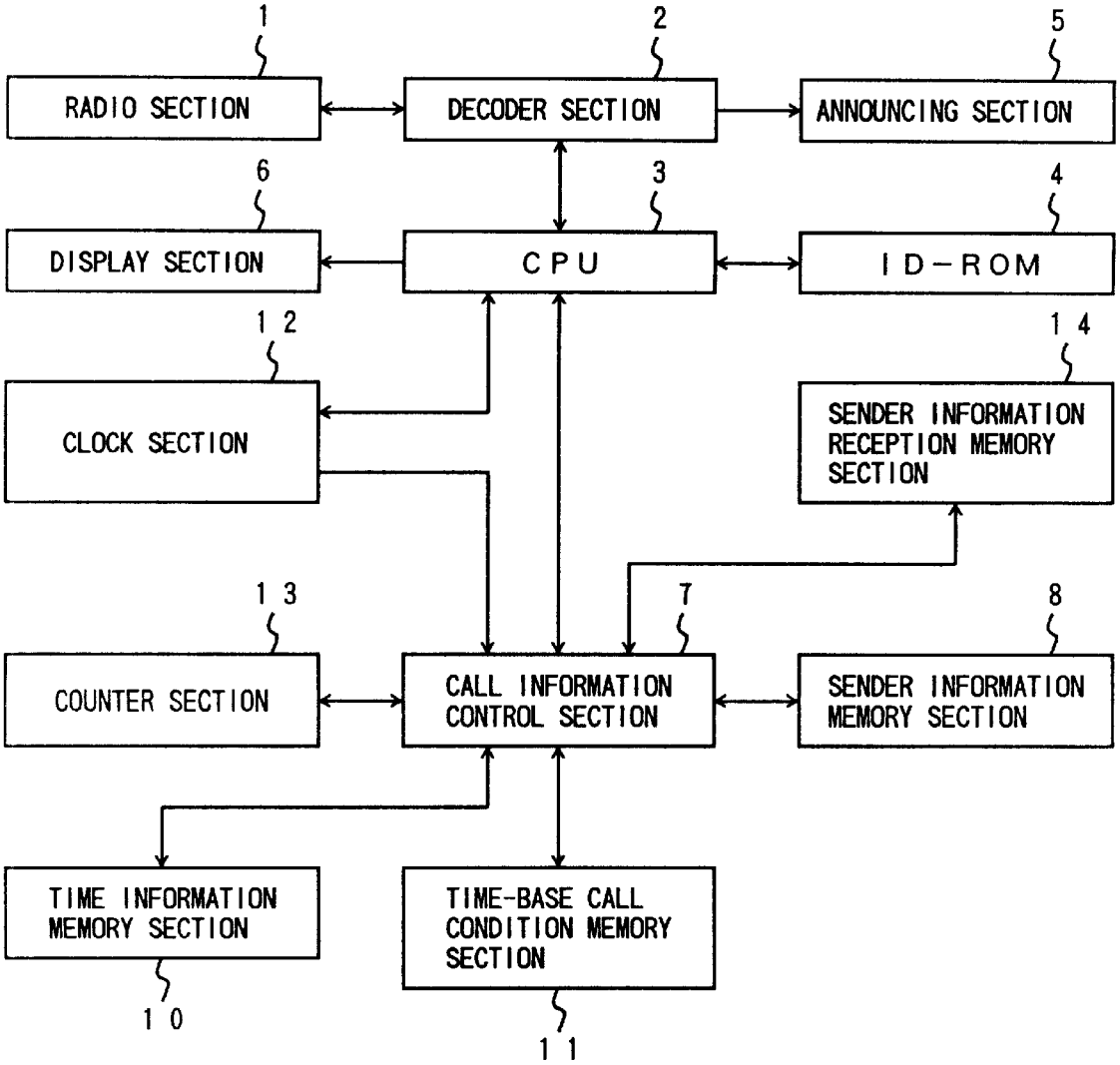
FIG. 8 is a block diagram of a radio paging receiver according to a third embodiment of this invention.

Turning to FIG. 8, description will proceed to a radio paging receiver according to a third embodiment of this invention. The radio paging receiver comprises similar parts designated by like reference numerals.

The memory section (8, 11) further includes the above-mentioned section (10) and a different section (14) which memorizes, as memorized number data, a plurality of number data (or information) in correspondence to the memorized sender data (or information), each of the memorized number data (or information) specifying the number of times of reception of the sender datum (or information) corresponding to each of the memorized number data (or information) as will also later be described. A possessor of the radio paging receiver can freely input or store a plurality of the number data (or information) in the section (14) at will.

In cooperation with a counter section 13 (later described), the control section 7 controls the announcing section 5 in response to the particular sender datum (or information) so that the announcing section 5 announces the reception of the call in the above-mentioned corresponding one of the memorized announcing mode data (or information) when the number of times of reception of the particular sender datum (or information) exceeds per a predetermined time interval the number of times specified by a corresponding one of the memorized number data (or information). The corresponding one of the memorized number data (or information) corresponds to the memorized sender datum (or information) which coincides with the particular sender datum (or information). Such operation of the control section 7 is carried out at steps Sd16 and Sd23 of FIG. 9B as will later be described.

Figure 9A:
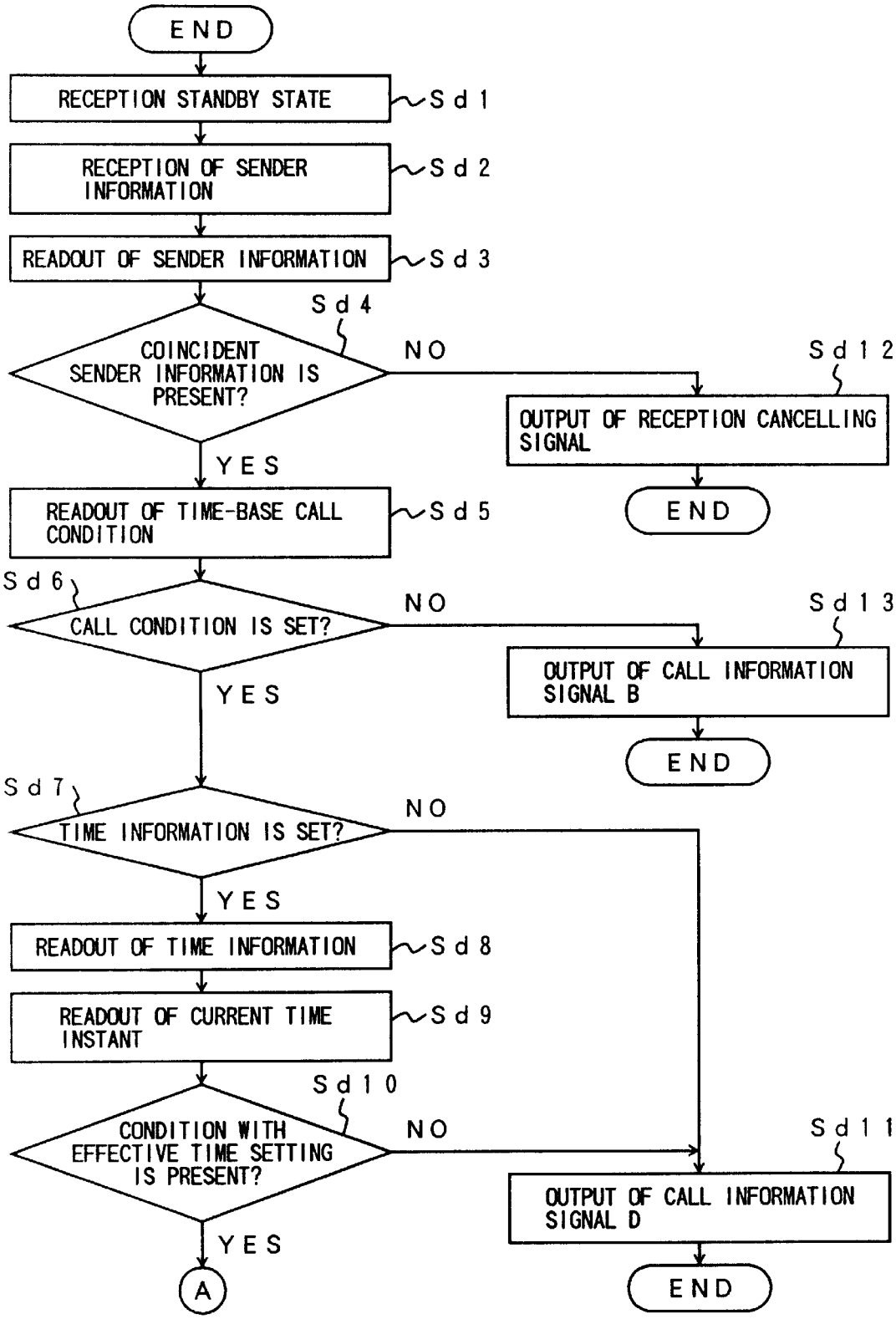
FIGS. 9A and 9B are flow charts for describing an operation of a call information control section in FIG. 8.
Figure 9B:
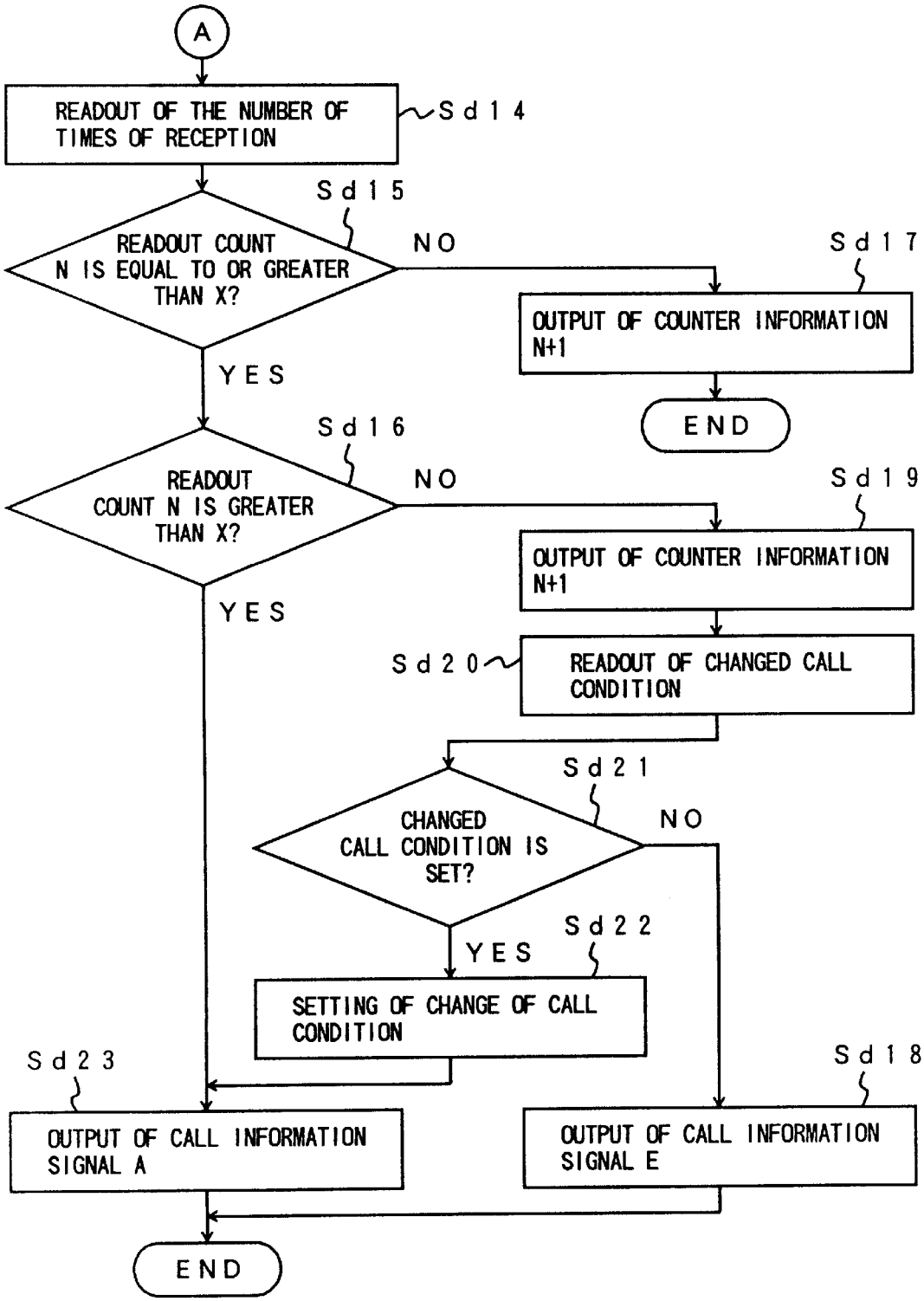

When the number of times of reception of the particular sender datum (or information) does not reach per the predetermined time interval the number of times specified by the corresponding one of the memorized number data (or information), the control section 7 controls the announcing section 5 in response to the particular sender datum (or information) so that the announcing section 5 does not announce the reception of the call in any of the announcing modes at steps Sd15 and Sd17 of FIG. 9B as will later be described.

The radio paging receivers according to the first through the third embodiments of this invention will be described more in detail.

First Embodiment

Referring to FIG. 3, the radio section 1 is for receiving and demodulating a radio paging signal to produce an output signal. The output signal of the radio section 1 is supplied to a decoder section 2.

The decoder section 2 processes the signal supplied from the radio section 1 and drives the announcing section 5 under control of a CPU (Central Processing Unit) 3.

The CPU 3 controls the operation of the radio section 1 through the decoder section 2 and makes a display section 6 display various kinds of characters, numerals, symbols, or designs in response to the information supplied from the decoder section 2.

The CPU 3 is connected to the decoder 2 and the display section 6 and also to the ID-ROM 4 and a call information control section 7.

The ID-ROM 4 memorizes a specific call number assigned to the receiver. The call information control section 7 compares sender information memorized in a sender information memory section 8 and sender information contained in the received signal and retrieves a call condition set and memorized in a call condition memory section 9 in correspondence to the sender information to carry out control based on the call condition.

A possessor of the receiver preliminarily makes the sender information memory section 8 set and memorize desired sender datum information (or datum) for identification of each expected sender. In addition, the possessor makes the call condition memory section 9 set and memorize a call condition (that is, a selected announcing mode) upon reception in correspondence to each sender information.

For example, the setting of the call condition is such that immediate announcement by sound generation is carried out for a call from a sender A while announcement is suspended and a message is held for a call from a sender B.

In this case, without memorizing the sender information in the sender information memory section 8, a desired call condition may be set and memorized in the call condition memory section 9 as a call condition for unregistered sender information.

If the possessor of the receiver does not specifically set any call condition, ordinary reception announcement is performed.

On the other hand, the sender transmits the sender information preliminarily determined by the sender and the possessor of the receiver in addition to the call number of the receiver and the message.

The transmitted signal is received as a radio signal and demodulated by the radio section 1 to be supplied to the decoder section 2.

The decoder section 2 collates through the CPU 3 the supplied information and the specific call number memorized in the ID-ROM 4. Upon detection of coincidence therebetween as a result of collation, the message signal following the call number and the sender information signal are supplied to the CPU 3.

The CPU 3 supplies the sender information signal to the call information control section 7. The call information control section 7 collates the sender information memorized in the sender information memory section 8 and the sender information signal supplied from the CPU 3.

Upon coincidence therebetween, the call condition set in the call condition memory section 9 is retrieved and a call information signal corresponding to a retrieved call condition (that is, the announcing mode) is supplied to the CPU 3.

The CPU 3 is responsive to the call information signal and makes the display section 6 display the message and supplies a reception announcement signal to the decoder section 2 to make the decoder section 2 drive the reception announcing section 5.

FIG. 4 is a flow chart for describing an example of operation of the call information control section 7 in this embodiment.

In FIGS. 3 and 4, the call information control section 7 is at first put into a standby state (step Sa1). In this state, the call information control section 7 is supplied with the sender information (that is, the particular sender datum) from the CPU 3 (step Sa2).

Supplied with the sender information, the call information control section 7 reads the sender information memorized in the sender information memory section 8 (step Sa3). Collation is carried out between the sender information supplied from the CPU 3 and the sender information read from the sender information memory section 8 (step Sa4).

If coincidence is detected as a result of collation in the step Sa4, the call condition memorized in the call condition memory section 9 is read (step Sa5) and confirmation is made about whether or not the call condition is set (step Sa6).

If the call condition is set in the step Sa6, the call condition corresponding to the sender information previously collated is retrieved (step Sa7). The call condition thus retrieved is supplied as a call information signal A to the CPU 3 (step Sa8). Then, the operation comes to an end.

On the other hand, if coincidence is not detected in the step Sa4, a reception cancelling signal (which makes the announcing unit 5 unannounce in any announcing mode) is supplied to the CPU 3 judging as unregistered sender information (step Sa9). Then, the operation comes to an end.

If the call condition corresponding to the sender information is not set in the step Sa6, a call information signal B for operating the announcing unit 5 in an ordinary announcing mode is supplied to the CPU 3 (step Sa10). The operation comes to an end.

After the operation comes to an end in each of the above-mentioned instances, the call information control section 7 returns to the step Sa1 to be put into the reception standby state. Thus, the above-mentioned operation is repeated.

FIG. 5 is a flow chart for describing another example of operation of the call information control section 7.

In this case, the call information control section 7 is at first put into the standby state (step Sb1). In this state, the call information control section 7 is supplied with the sender information from the CPU 3 (step Sb2).

Supplied with the sender information, the call information control section 7 reads the sender information memorized in the sender information memory section 8 (step Sb3). Collation is carried out between the sender information supplied from the CPU 3 and the sender information read from the sender information memory section 8 (step Sb4).

If coincidence is detected as a result of collation in the step Sb4, the call condition memorized in the call condition memory section 9 is read (step Sb5) and confirmation is made about whether or not the call condition is set (step Sb6).

If the call condition is set in the step Sb6, the call condition corresponding to the sender information previously collated is retrieved (step Sb7). The call condition thus retrieved is supplied as the call information signal A to the CPU 3 (step Sb8). Then, the operation comes to an end.

On the other hand, if coincidence is not detected in the step Sb4, retrieval and collation are executed to detect whether or not the call condition for unregistered sender information is registered in the call condition memory section 9 (step Sb9).

If the call condition for unregistered sender information is present as a result of collation, the call condition in question is supplied to the CPU 3 as a call information signal C (step Sb10). Then, the operation comes to an end.

On the other hand, if no call condition for unregistered sender information is present, the reception cancelling signal is supplied to the CPU 3 (step Sb11). Then, the operation comes to an end.

If the call condition corresponding to the sender information is not set in the step Sb6, the call information signal B for operating the ordinary reception announcing unit is supplied to the CPU 3 (step Sb12). The operation comes to an end.

After the operation comes to an end in each of the above-mentioned instances, the call information control section 7 returns to the step Sb1 to be put into the reception standby state. Thus, the above-mentioned operation is repeated.

Second Embodiment

Referring to FIG. 6, a time information memory section 10, a time-base call condition memory section 11, and a clock section 12 for detecting a current time instant are connected to the call information control section 7 in addition to the sender information memory section 8.

The clock section 12 is also connected to the CPU 3. After supplied through the CPU 3 with the current time instant, the clock section 12 measures and holds the time instant.

In this embodiment, the possessor of the receiver preliminarily makes the sender information memory section 8 set and memorize desired sender information and the time information memory section 10 memorize one or a plurality of desired time periods as time information.

A desired call condition corresponding to the sender information is combined with the time information memorized in the time information memory section 10 to produce a time-base call condition which is set and memorized in the time-base call condition memory section 11.

The time-base call condition is arbitrarily selected with respect to each different time information. Therefore, the call condition corresponding to the sender information can be set in the time-base call condition memory section 11 as a plurality of time-base call conditions.

A call condition without the time information added thereto can be set in the time-base call condition memory section 11 as one of the time-base call conditions.

For example, for a call from a sender A, it is possible to select reception announcement by sound generation between 8 a.m. and 5 p.m., reception announcement by vibration between 5 p.m. and 11 p.m., and no announcement between 12 p.m. and 8 a.m. Thus, the time is scheduled and divided.

In the above-mentioned manner, a plurality of different call conditions can be set with respect to the same sender information.

Figure 7:
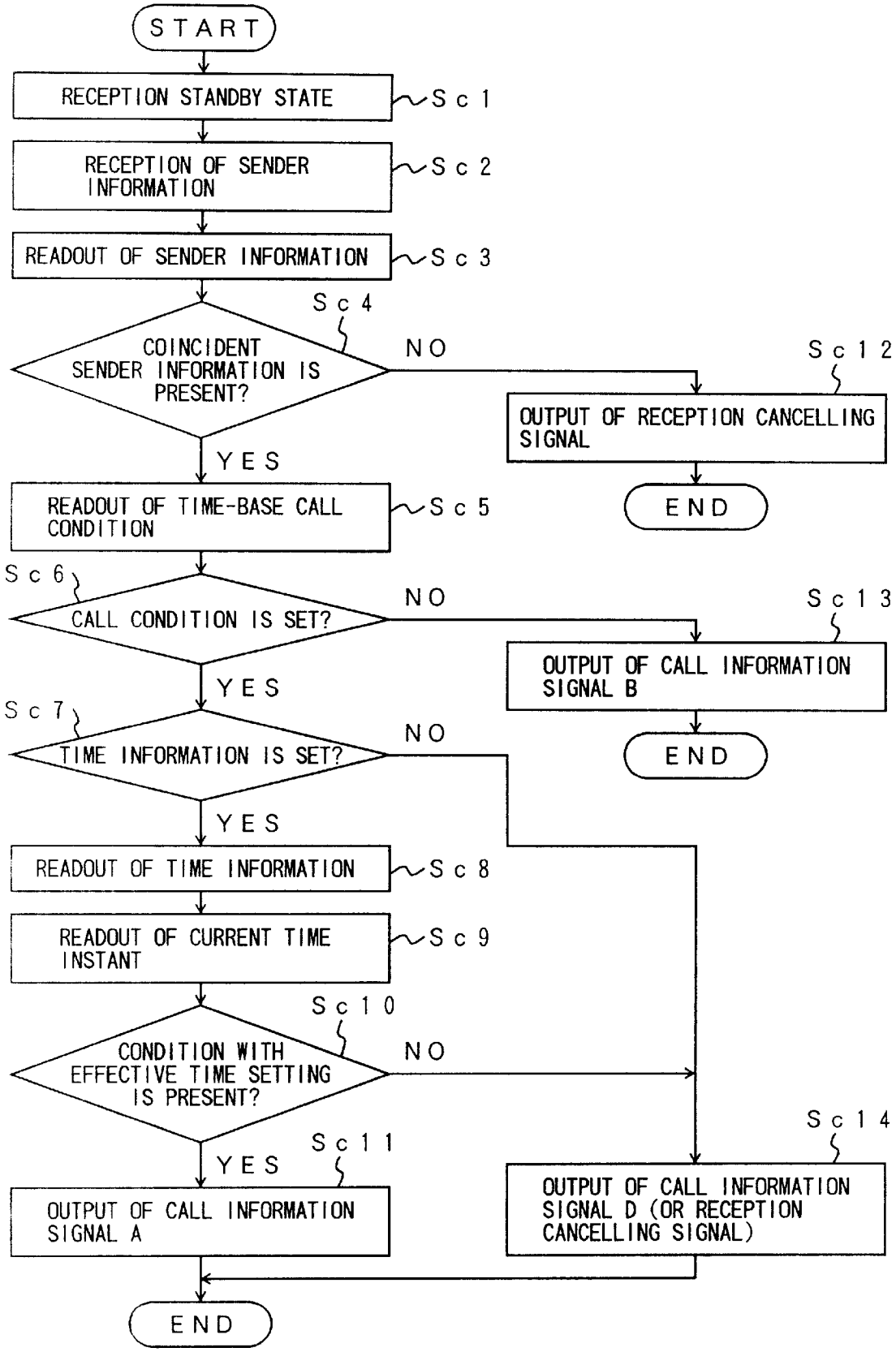
FIG. 7 is a flow chart for describing an operation of a call information control section in FIG. 6.

FIG. 7 is a flow chart for describing an example of operation of the call information control section 7 in this embodiment.

According to this embodiment, the call information control section 7 is at first put into the standby state (step Sc1). In this state, the call information control section 7 is supplied with the sender information from the CPU 3 (step Sc2).

Supplied with the sender information, the call information control section 7 reads the sender information memorized in the sender information memory section 8 (step Sc3). Collation is carried out between the sender information supplied from the CPU 3 and the sender information read from the sender information memory section 8 (step Sc4).

If coincidence is detected as a result of collation, the call condition memorized in the time-base call condition memory section 11 in correspondence to the sender information is read (step Sc5) and confirmation is made about whether or not the call condition is set (step Sc6).

If the call condition is set in the step Sc6, confirmation is made about whether or not the time information is set and added to the call condition (step Sc7).

If the time information is set and added, the time information set in the time information memory section 10 is read (step Sc8) and the current time instant is read from the clock section 12 (Step Sc9).

Next, collation and retrieval are carried out to detect, in the time-base call condition, whether or not the time information effective at the current time instant is set (step Sc10). The time-base call condition thus retrieved is supplied as the call information signal A to the CPU 3 (step Sc11).

On the other hand, if coincidence is not detected in the step Sc4, the reception cancelling signal is supplied to the CPU 3 judging as unregistered sender information (step Sc12). Then, the operation comes to an end.

If the call condition corresponding to the sender information which has been read is not set in the step Sc6, the call information signal B for operating the ordinary reception announcing unit is supplied to the CPU 3 (step Sc13). The operation comes to an end.

If no time information is set and added to the call condition in the step Sc7 or if no effective time information is set in the step Sc10, the call condition without the time information added thereto is delivered as a call information signal D to the CPU 3 (step Sc14). Alternatively, the reception cancelling signal is delivered to the CPU 3 instead of the call information signal D in the step Sc14. Then, the operation comes to an end.

After the operation comes to an end in each of the above-mentioned instances, the call information control section 7 returns to the step Sc1 to be put into the reception standby state. Thus, the above-mentioned operation is repeated.

In this embodiment, description has been made about the control by the time instants. Alternatively, the call condition can be set with reference to the lapse of time. The same setting for the time information can be continuously repeated.

Third Embodiment

Referring to FIG. 8, a counter section 13 and a sender information reception memory section 14 are connected to the call information control section 7 in addition to the sender information memory section 8, the time information memory section 10, and the time-base call condition memory section 11.

In this embodiment, the possessor of the receiver preliminarily makes the sender information memory section 8 set and memorize desired sender information and the time information memory section 10 memorize one or a plurality of desired time periods as time information.

A desired call condition corresponding to the sender information is combined with the time information memorized in the time information memory section 10 to produce a time-base call condition which is set and memorized in the time-base call condition memory section 11.

Furthermore, the sender information reception memory section 14 is made to set and memorize the number of times of reception of the sender information from the same sender within an effective time period and a call condition corresponding to the memorized number of times. If the same sender information is received at a specific number of times within a predetermined time period, the priority degree in reception and reception announcement can automatically be changed under a predetermined condition. The changed setting can automatically be recovered to the initial setting.

If the call condition dependent upon the number of times of reception is not set, the time-base call condition memorized in the time-base call condition memory section 11 is rendered valid. The counter section 13 counts the number of times of reception of the sender information within the predetermined time period.

FIGS. 9A and 9B are flow charts for describing an example of operation of the call information control section 7 in this embodiment.

According to this example, the call information control section 7 is at first put into the standby state (step Sd1, see FIG. 9A). In this state, the call information control section 7 is supplied with the sender information from the CPU 3 (step Sd2).

Supplied with the sender information, the call information control section 7 reads the sender information memorized in the sender information memory section 8 (step Sd3). Collation is carried out between the sender information supplied from the CPU 3 and the sender information read from the sender information memory section 8 (step Sd4).

If coincidence is detected as a result of collation, the call condition memorized in the time-base call condition memory section 11 in correspondence to the sender information is read (step Sd5) and confirmation is made about whether or not the call condition is set (step Sd6).

If the call condition is set in the step Sd6, 9 confirmation is made about whether or not the time information is set and added to the call condition (step Sd7).

If the time information is set and added, the time information set in the time information memory section 10 is read (step Sd8) and the current time instant is read from the clock section 12 (Step Sd9).

Next, collation and retrieval are carried out to detect, in the time-base call condition, whether or not the time information effective at the current time instant is set (step Sd10).

If no effective time information is set in the step Sd10 or if no time information is set and added to the call condition in the step Sd7, the call condition without the time information added thereto is delivered as the call information signal D to the CPU 3 (step Sd11). Then, the operation comes to an end.

On the other hand, if coincidence is not detected in the step Sd4, the reception cancelling signal is supplied to the CPU 3 judging as unregistered sender information (step Sd12). Then, the operation comes to an end.

If the call condition corresponding to the sender information which has been read is not set in the step Sd6, the call information signal B for operating the ordinary reception announcing unit is supplied to the CPU 3 (step Sd13). The operation comes to an end.

If the time-base call condition contains the time information effective at the current time instant in the step Sd10, the count value is read from the counter section 13 for counting the number of times of reception of the sender information collated in the step Sd4 (step Sd14, see FIG. 9B).

Then, confirmation is made about whether or not the number of times of reception read in the step Sd14 is equal to or greater than a preselected number X preliminarily set in the sender information reception memory section 14 (step Sd15). If the number of times of reception is equal to or greater than the preselected number X, confirmation is next made about whether or not the number of times of reception is greater than the number of times X (step Sd16).

If the number of times of reception does not reach the preselected number X in the step Sd15, counter information is produced to make the number of times of reception counted by the counter 13 be increased by 1 (step Sd17).

Thereafter, the time-base call condition having the effective time information and retrieved in the step Sd10 is delivered as a call information signal E to the CPU 3 (step Sd18). Then, the operation comes to an end.

On the other hand, if the number of times of reception is equal to the preselected number X in the step Sd16, the counter information is produced to make the number of times reception counted by the counter section 13 be increased by 1 (step Sd19). Thereafter, a changed call condition set in the sender information reception memory section 14 is read (step Sd20). Confirmation is made about whether or not the changed call condition is set (step Sd21).

If the changed call condition is not set in the step Sd21, the operation proceeds to the step Sd18.

On the other hand, if the changed call condition is set in the step Sd21, the time-base call condition retrieved in the step Sd10 and having the effective time information is set so that the changed call condition has a priority (step Sd22).

After setting the time-base call condition in the step Sd22 or if the number of times of reception is greater than the preselected number X in the step Sd16, the changed call condition is delivered as the call condition signal A to the CPU 3 (step Sd23). Then, the operation comes to an end.

After the operation comes to an end in each of the above-mentioned instances, the call information control section 7 returns to the step Sd1 to be put into the reception standby state. Thus, the above-mentioned operation is repeated.

Figure 10A:
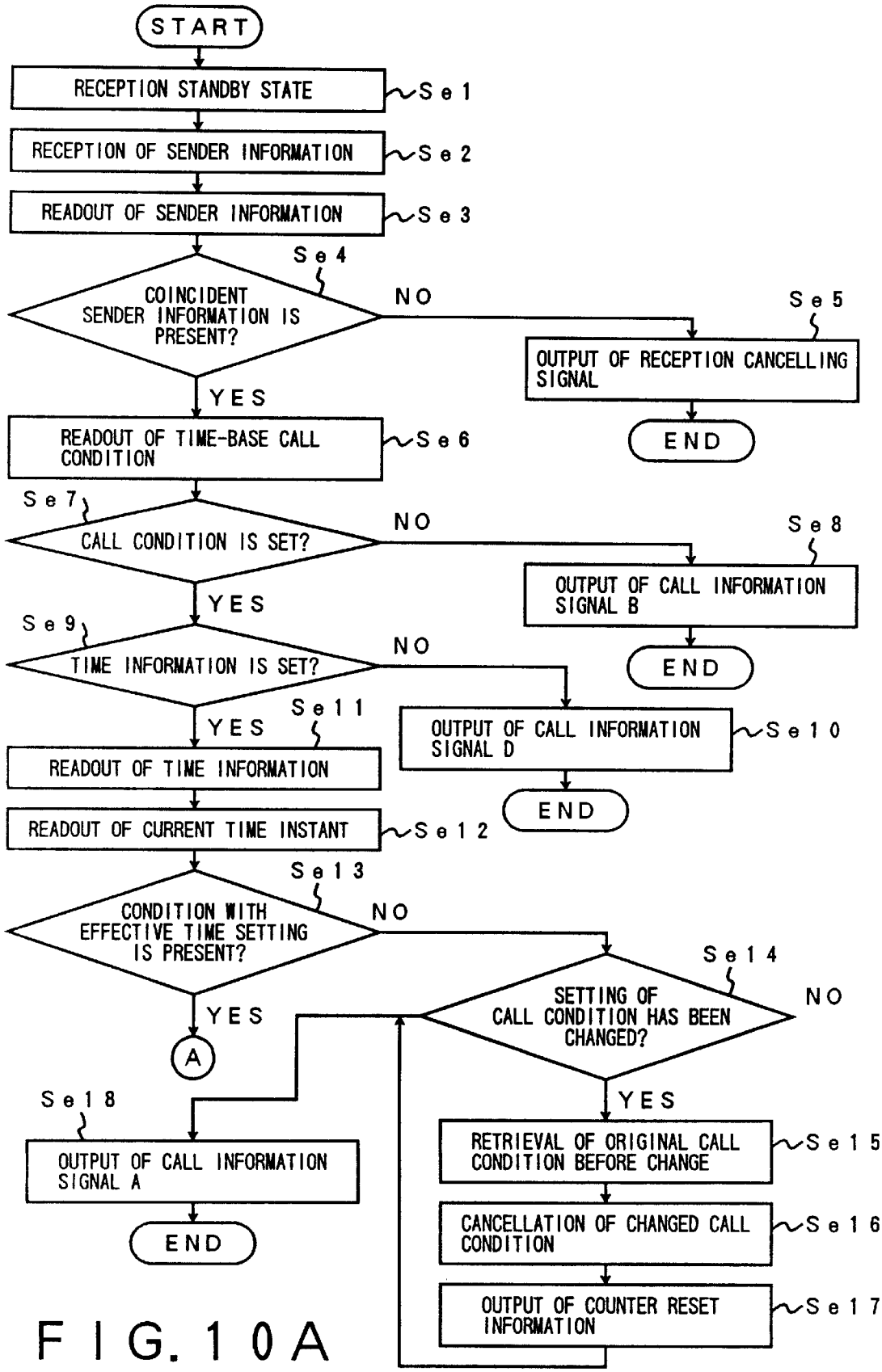
FIGS. 10A and 10B are flow charts for describing another operation of a call information control section in FIG. 8.
Figure 10B:
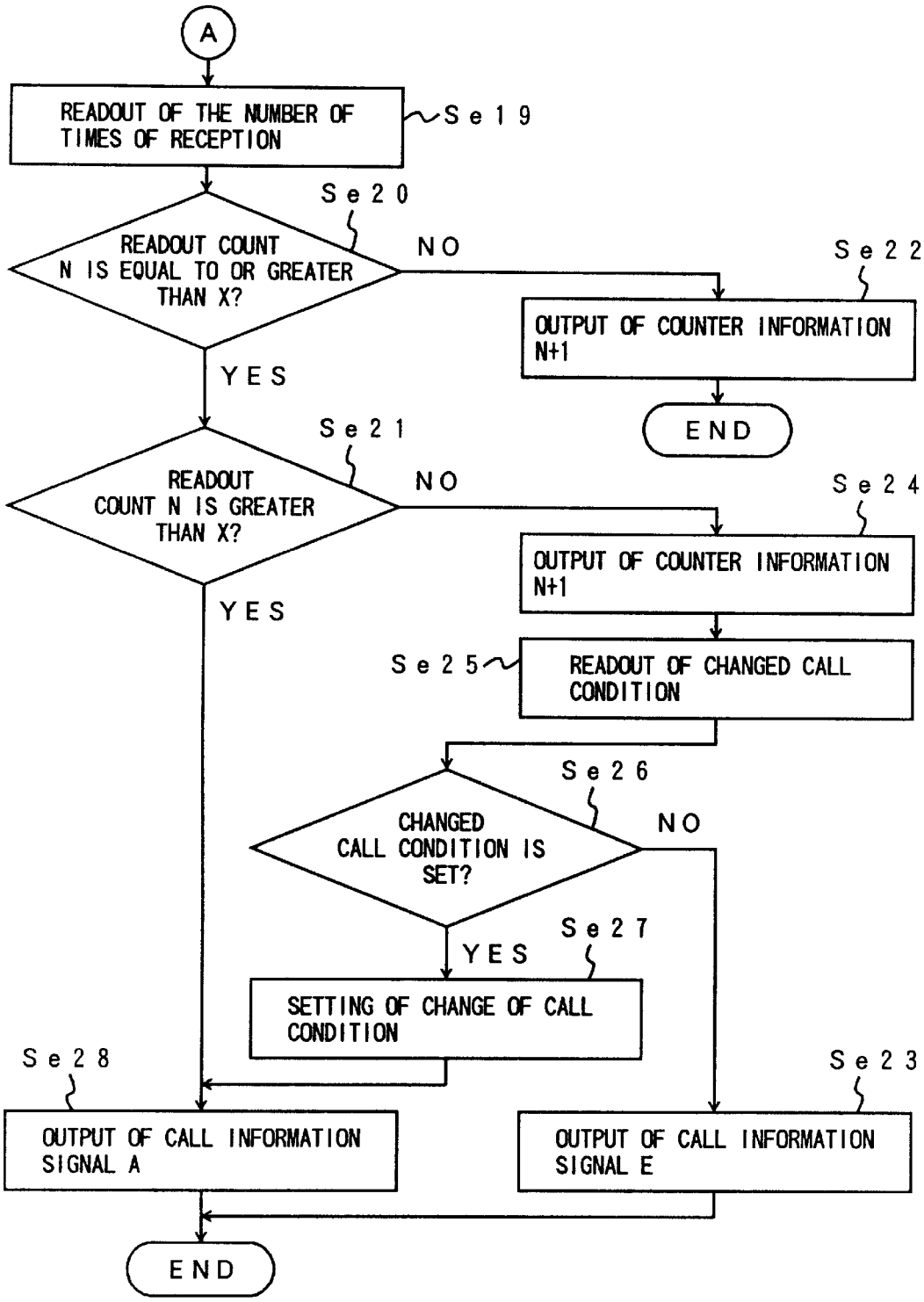

FIGS. 10A and 10B are flow charts for describing another example of operation of the call information control section 7 in the third embodiment of this invention.

In this example, the call information control section 7 is at first put into the standby state (step Se1, see FIG. 10A). In this state, the call information control section 7 is supplied with the sender information from the CPU 3 (step Se2).

Supplied with the sender information, the call information control section 7 reads the sender information memorized in the sender information memory section 8 (step Se3). Collation is carried out between the sender information supplied from the CPU 3 and the sender information read from the sender information memory section 8 (step Se4).

If coincidence is not detected in the step Se4, the reception cancelling signal is supplied to the CPU 3 judging that the sender information is not registered (step Se5). The operation comes to an end.

On the other hand, if coincidence is detected as a result of collation in the step Se4, the call condition memorized in the time-base call condition memory section 11 in correspondence to the sender information is read (step Se6) and confirmation is made about whether or not the call condition is set (step Se7).

If the call condition corresponding to the sender information which has been read is not set in the step Se7, the call information signal B for operating the ordinary reception announcing unit is supplied to the CPU 3 (step Se8). The operation comes to an end.

On the other hand, if the call condition is set in the step Se6, confirmation is made about whether or X not the time information is set and added to the call condition (step Se9).

If no time information is set and added to the call condition in the step Se9, the call condition without the time information added thereto is delivered as the call information signal D to the CPU 3 (step Se10). Then, the operation comes to an end.

If the time information is set and added in the step Se9, the time information set in the time information memory section 10 is read (step Se11) and the current time instant is read from the clock section 12 (Step Se12).

Next, collation and retrieval are carried out to detect, in the time-base call condition, whether or not the time information effective at the current time instant is set (step Se13).

If no effective time information is set in the step Se13, judgement is made about whether or not the setting of the call condition has been changed (step Se14).

If the setting of the call condition has been changed in the step Se14, the original call condition before the change is retrieved (step Se15). Thereafter, resetting is carried out to cancell the changed setting of the call condition and to make the original time-base call condition have a priority (step Se16).

Then, a counter reset signal is delivered to the counter section 13 to reset the number of times of reception of the sender information (step Se17).

After processing in the step Se17 or if the setting of the call condition has not been changed in the step Se14, the current time-base call condition is delivered as the call information signal A to the CPU 3 (step Se18). Then, the operation comes to an end.

If the time-base call condition contains the time information effective at the current time instant in the step Se13, the count value is read from the counter section 13 for counting the number of times of reception of the sender information collated in the step Se4 (step Se19, see FIG. 10B).

Then, confirmation is made about whether or not the number of times of reception read in the step Sd19 is equal to or greater than the preselected number X preliminarily set in the sender information reception memory section 14 (step Se20). If the number of times of reception is equal to or greater than the preselected number X, confirmation is next made about whether or not the number of times of reception is greater than the preselected number X (step Se21).

If the number of times of reception does not reach the preselected number X in the step Se20, counter information is produced to make the number of times of reception counted by the counter 13 be increased by 1 (step Se22).

Thereafter, the time-base call condition having the effective time information and retrieved in the step Se13 is delivered as the call information signal E to the CPU 3 (step Se23). Then, the operation comes to an end.

On the other hand, if the number of times of reception is equal to the preselected number X in the step Se21, the counter information is produced to make the number of times of reception counted by the counter section 13 be increased by 1 (step Se24). Thereafter, a changed call condition set in the sender information reception memory section 14 is read (step Se25). Confirmation is made about whether or not the changed call condition is set (step Se26).

If the changed call condition is not set in the step Se26, the operation proceeds to the step Se23.

On the other hand, if the changed call condition is set in the step Se26, the time-base call condition retrieved in the step Se13 and having the effective time information is set so that the changed call condition has a priority (step Se27).

After setting the time-base call condition in the step Se27 or if the number of times of reception is greater than the preselected number X in the step Se21, the changed call condition is delivered as the call condition signal A to the CPU 3 (step Se28). Then, the operation comes to an end.

After the operation comes to an end in each of the above-mentioned instances, the call information control section 7 returns to the step Se1 to be put into the reception standby state. Thus, the above-mentioned operation is repeated.

In this embodiment, description has been directed to the control by the time zone and the number of times of reception. However, change in setting of the call condition can be continuously repeated.

What is claimed is:

1. A radio paging receiver which includes an announcing section having a plurality of announcing modes and which carries out a call announcement for announcing, by the use of said announcing section, reception of a call generated by a particular sender, said receiver comprising:

a re-programmable memory for setting and memorizing, as memorized sender data, a plurality of sender data input by the radio paging receiver user specifying the identification of each of a plurality of senders and for setting and memorizing, as memorized announcing mode data, a plurality of announcing mode data specifying the announcing modes of said announcing section in correspondence to said memorized sender data;

a processing section supplied with a radio signal carrying a particular sender datum specifying said particular sender for processing said radio signal into said particular sender datum; and a controlling section connected to said re-programmable memory and said processing section for controlling said announcing section in response to said particular sender datum so that said announcing section announces the reception of said call in the announcing mode specified by a corresponding one of said memorized announcing mode data, said corresponding one of the memorized announcing mode data corresponding to the memorized sender datum which coincides with said particular sender datum.

2. A radio paging receiver as claimed in claim 1, said radio signal further carrying a specific call number which is specific to said receiver and which precedes said particular sender datum, wherein:

said processing section processes said radio signal into said particular sender datum when said processing section detects said specific call number.

3. A radio paging receiver as claimed in claim 1, wherein:

said controlling section controls said announcing section in response to said particular sender datum so that said announcing section does not announce (Sa4, Sa9, Sb4, Sb11) the reception of said call in any of said announcing modes when none of said memorized sender data coincide with said particular sender datum.

4. A radio paging receiver as claimed in claim 1, wherein:

said controlling section controls said announcing section in response to said particular sender datum so that said announcing section announces (Sa6, Sa10, Sb6, Sa12) the reception of said call in a predetermined mode of said announcing modes when no announcing mode datum is memorized in said memory in correspondence to the memorized sender datum which coincides with said particular sender datum.

5. A radio paging receiver as claimed in claim 1, wherein:

said memory further comprises re-programmable time memory for memorizing time zone data, a plurality of time zone data input by the radio paging receiver user specifying time zones in correspondence to said memorized sender data;

said controlling section controlling said announcing section in response to said particular sender datum so that said announcing section announces the reception of said call in said corresponding one of the memorized announcing mode data when a reception time of said particular sender datum is within the time zone specified by a corresponding one of said memorized time zone data, said corresponding one of the memorized time zone data corresponding to the memorized sender datum which coincides with said particular sender datum.

6. A radio paging receiver as claimed in claim 5, wherein:

said controlling section controls said announcing section in response to said particular sender datum so that said announcing section does not announce (Sc7, Sc14) the reception of said call in any of said announcing modes when the reception time of said particular sender datum is out of the time zone specified by said corresponding one of the memorized time zone data.

7. A radio paging receiver as claimed in claim 1, wherein:

said memory further comprises re-programmable number memory for memorizing number data input by the radio paging receiver user, a plurality of number data in correspondence to said memorized sender data, each of said memorized number data specifying the number of times of reception of the sender datum corresponding to each of said memorized number data;

said controlling section controlling said announcing section in response to said particular sender datum so that said announcing section announces the reception of said call in said corresponding one of the memorized announcing mode data when the number of times of reception of said particular sender datum exceeds per a predetermined time interval the number of times specified by a corresponding one of said memorized number data, said corresponding one of the memorized number data corresponding to the memorized sender datum which coincides with said particular sender datum.

8. A radio paging receiver as claimed in claim 7, wherein:

said controlling section controls said announcing section in response to said particular sender datum so that said announcing section does not announce (Sd15, Sd17) the reception of said call in any of said announcing modes when the number of times of reception of said particular sender datum does not reach per said predetermined time interval the number of times specified by said corresponding one of the memorized number data.

9. A radio paging receiver having an announcing section with a plurality of announcing modes and which, by the use of said announcing section, carries out a call announcement for announcing reception of a call generated by a particular sender, said radio paging receiver comprising:

a re-programmable memory for setting and memorizing: i) as memorized sender data, a plurality of sender data specifying the identification of each of a plurality of senders and ii) as memorized announcing mode data, a plurality of announcing mode data specifying the announcing modes of said announcing section in correspondence to the memorized sender data;

a processing section supplied with a radio signal carrying a particular sender datum specifying the particular sender for processing the radio signal into the particular sender datum; and a controlling section connected to said memory and said processing section for controlling said announcing section in response to the particular sender datum so that said announcing section announces the reception of the call in the announcing mode specified by a corresponding one of the memorized announcing mode data, the corresponding one of the memorized announcing mode data corresponding to the memorized sender datum which coincides with the particular sender datum, wherein said re-programmable memory comprises a sender identity memory section for memorizing information to identify particular expected senders, and a call condition memory section for holding an announcing mode associated with each of the expected senders memorized in said sender identity memory section.

10. The radio paging receiver of claim 9, wherein the call condition memory section is designed and constructed so that a radio paging receiver user can selectively program said call condition memory section to either immediately announce a call from a first expected sender or to suspend announcement and hold a message from the first expected sender.

* * * * *